US007781012B2

(12) United States Patent
Schaefer

(10) Patent No.: US 7,781,012 B2
(45) Date of Patent: Aug. 24, 2010

(54) METHOD AND INSTALLATION FOR COATING, ESPECIALLY PAINTING, ARTICLES

(75) Inventor: Wolf-Hasso Schaefer, Tiefenbronn-Muehlhausen (DE)

(73) Assignee: Eisenmann Anlagenbau GmbH & Co. KG, Boeblingen (DE)

( * ) Notice: Subject to any disclaimer, the term of this patent is extended or adjusted under 35 U.S.C. 154(b) by 597 days.

(21) Appl. No.: 11/721,118

(22) PCT Filed: Dec. 2, 2005

(86) PCT No.: PCT/EP2005/012307

§ 371 (c)(1),
(2), (4) Date: Jun. 7, 2007

(87) PCT Pub. No.: WO2006/063648

PCT Pub. Date: Jun. 22, 2006

(65) Prior Publication Data

US 2009/0232980 A1 Sep. 17, 2009

(30) Foreign Application Priority Data

Dec. 13, 2004 (DE) ..... 10 2004 059 870

(51) Int. Cl.
*B05D 1/12* (2006.01)
*B05B 12/14* (2006.01)
*B05B 7/14* (2006.01)

(52) U.S. Cl. ..... 427/180; 118/310; 401/118

(58) Field of Classification Search ..... 427/180; 118/310; 401/118
See application file for complete search history.

(56) References Cited

U.S. PATENT DOCUMENTS

| | | | | |
|---|---|---|---|---|
| 3,637,135 | A * | 1/1972 | Luderer et al. | 239/3 |
| 2002/0046698 | A1 | 4/2002 | Congard et al. | |
| 2002/0046699 | A1 | 4/2002 | Congard et al. | |
| 2005/0158463 | A1 * | 7/2005 | Browning et al. | 427/180 |

FOREIGN PATENT DOCUMENTS

| | | |
|---|---|---|
| WO | WO 97/34707 | 9/1997 |

* cited by examiner

*Primary Examiner*—Frederick J Parker
(74) *Attorney, Agent, or Firm*—Factor & Lake, Ltd.

(57) ABSTRACT

A method and an installation for coating, especially painting, articles. The method is characterized by filling nonabrasive powder containers with the powdery coating material and transporting the containers to the vicinity of an application device. The powder containers are opened only in the vicinity of the application device and the powder is removed and then released by the application device onto the article to be coated. The avoids substantial dirtying of the transport paths that the powder containers are transported on, thereby eliminating the need for cleaning when the coating material is changed, especially when the coating powder is changed.

40 Claims, 9 Drawing Sheets

METHOD AND INSTALLATION FOR COATING, ESPECIALLY PAINTING, ARTICLES

RELATED APPLICATIONS

This application claims the filing benefit of PCT Patent Application No. PCT/EP2005/012307, filed Dec. 5, 2005; which claims the benefit of German Patent Application No. 10 2004 059 870.3, filed Dec. 13, 2004; the contents of which all are incorporated herein by reference.

TECHNICAL FIELD

The invention relates to a method for coating, especially painting, articles, in which the coating material is conveyed to an applying device and released by the latter in powder form; and also to an installation for carrying out the said method.

BACKGROUND OF THE INVENTION

The powder-coating, especially painting, of articles and, in this connection again, especially the painting of vehicle bodies, has been gaining increasing interest in recent times. One especially important reason for this is eco-friendliness since no solvents, the disposal of which often entails a major outlay on apparatus, occur in the case of power-coating. In spite of this major, obvious advantage, only limited use of powder-coating has hitherto been made.

This is attributable to the fact that the powder contaminates all the flow paths on the way to the applying device, so that a considerable outlay on cleaning is needed when there is a change in the coating material, that is to say, for example, a change in the colour of the paint powder. Therefore, wherever articles are to be acted upon by different coating materials, especially different-coloured paint powders, in a multicoloured sequence, the use of powder-coating has hitherto still been somewhat uneconomic. The downtimes of the installation which are required for cleaning purposes when the coating material is changed are simply too long.

The present invention is directed to resolving these and other matters.

SUMMARY OF THE INVENTION

An object of the present invention is to provide a method and an installation of the type initially mentioned, which permit an efficient, cost-effective coating operation, even in the event of a frequent change in the coating material, especially in the colour of the paint powder used.

With regard to the method, this object may be achieved through the fact that the coating material is conveyed, at least over part of the route to the applying device, in an abrasion-proof powder container, from which the pulverulent coating material is removed only in the vicinity of said applying device.

According to the invention, therefore, the coating material is not conveyed, at least over the majority of its transport route, as an unconfined powder which might contaminate the said transport route. Rather, the coating material is transported in an abrasion-proof powder container which leaves behind no "traces" in the form of powder and therefore does not necessitate any cleaning of the transport route.

In one advantageous form of embodiment of the method according to the invention, the quantity of coating material needed by an applying device for a complete coating operation for a specific article is weighed out and conveyed, as a whole, in a powder container.

In most cases, especially when painting vehicle bodies, it is sufficient if use is made of powder containers which possess approximately a holding capacity of 2000 g of coating material.

It is recommended that powder containers of such a size be conveyed back after the emptying operation and, optionally, also cleaned.

Alternatively, it is possible for portions of coating material which are small, compared to the total quantity of the coating material which is needed for a painting operation, to be conveyed in correspondingly small powder containers. This variant of the method is especially flexible and also makes it possible to optionally mix different coating materials which are to be applied together. In the present context, "small" compared to the total quantity means that the total quantity amounts to a multiple, for example a hundred times or fifty times or ten times, the individual portion.

Another advantage of using comparatively small portions of coating material consists in the fact that the total quantity of coating material supplied to the applying device can be determined by counting the powder containers conveyed. The smaller the powder containers, the more precisely can the required total quantity of coating material be metered.

Should this variant of the provider-coating operation be employed, use may be made of powder containers whose holding capacity for coating material is smaller than 50 g, preferably smaller than 20 g.

The powder containers may consist, especially, of plastic or metal, that is to say a metal which can be broken open is inert, inexpensive and easy to break open.

It is especially preferred if especially the small powder containers consist of clear-lacquer material. Any abraded material from these powder containers which nevertheless remained in the transport paths in the worst case would be harmless. Furthermore, these powder containers can be crushed and released, together with the coating material, via the applying device, so that no separate disposal is required.

It is also advantageous to convey the powder containers through the supply line by means of a pushing medium after the fashion of a pneumatic tube conveyor or a pipe-clearing device. Compressed air is recommended as the pushing medium.

With regard to the installation of one embodiment of the present invention, the aforesaid object may be achieved through: the supplying device being configured in such a way that it is able to transport the pulverulent coating material in the interior of powder containers consisting of abrasion-proof material; and at that end of the supplying device which faces towards the applying device, an opening device is provided which is able to open the powder containers and remove the pulverulent coating material from the interior thereof in order to pass it on to the applying device.

The advantages of the installation according to the present invention correspond, mutatis mutandis, to the abovementioned advantages of the method according to the present invention. The expedient configurations of the installation according to the present invention indicated in the claims also have, essentially, an analogue in a variant of the method whose advantages have been explained above, so that reference may be made to said variant.

These and other objects and advantages will be made apparent from the following brief description of the drawings and the detailed description of the invention.

DETAILED DESCRIPTION OF THE PRESENT INVENTION

Figure 1:
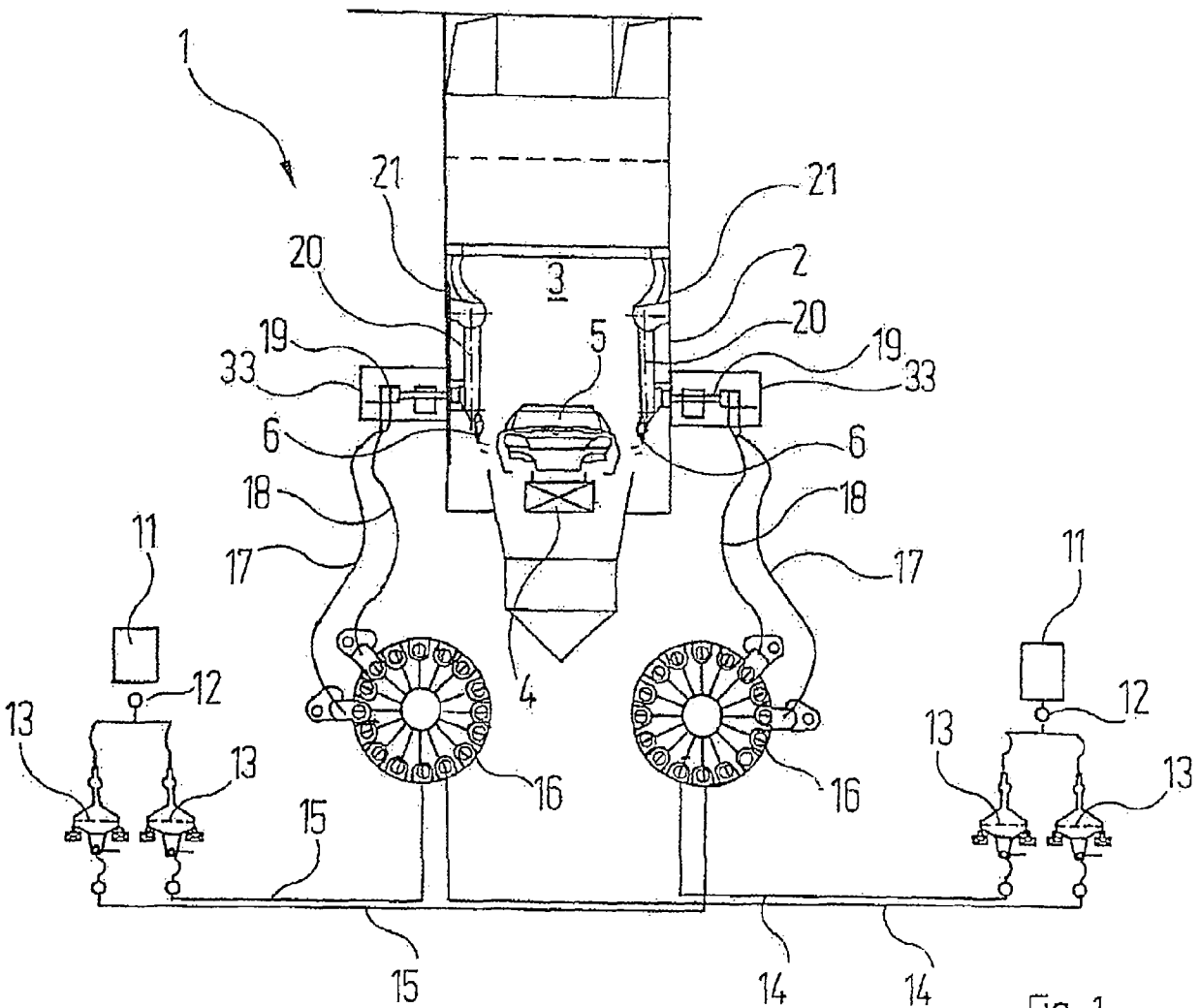
FIG. 1 shows, diagrammatically, an installation for painting vehicle bodies.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The painting installation which is represented in FIG. 1 and is provided, as a whole, with the reference numeral 1, comprises a painting booth 2 which is known per se and through the interior space 3 of which the vehicle bodies 5 to be painted can be transported with the aid of a transport system 4 which is represented only diagrammatically.

The painting installation 1 is set up so as to be essentially symmetrical in relation to its median plane; it is therefore sufficient to describe, below, only the half which is represented to the right of the median plane in FIG. 1.

An applying device 6, which is guided by a robot 20 in a manner which is likewise known, sprays paint in powder form onto the vehicle body 5 which may stand still, or even be moved, during this operation. Said applying device 6 contains a high-voltage electrode, past which the paint powder is guided and is thus ionised. This paint powder is then preferably deposited on the vehicle body 5 which is at earth potential.

The special feature of the painting installation 1 represented consists in the way in which the paint powder sprayed by the applying device 6 is supplied to the applying devices 6 by a number of storage containers 11—two in the exemplified embodiment represented—which are filled with paint powders of different colours.

Figure 2:
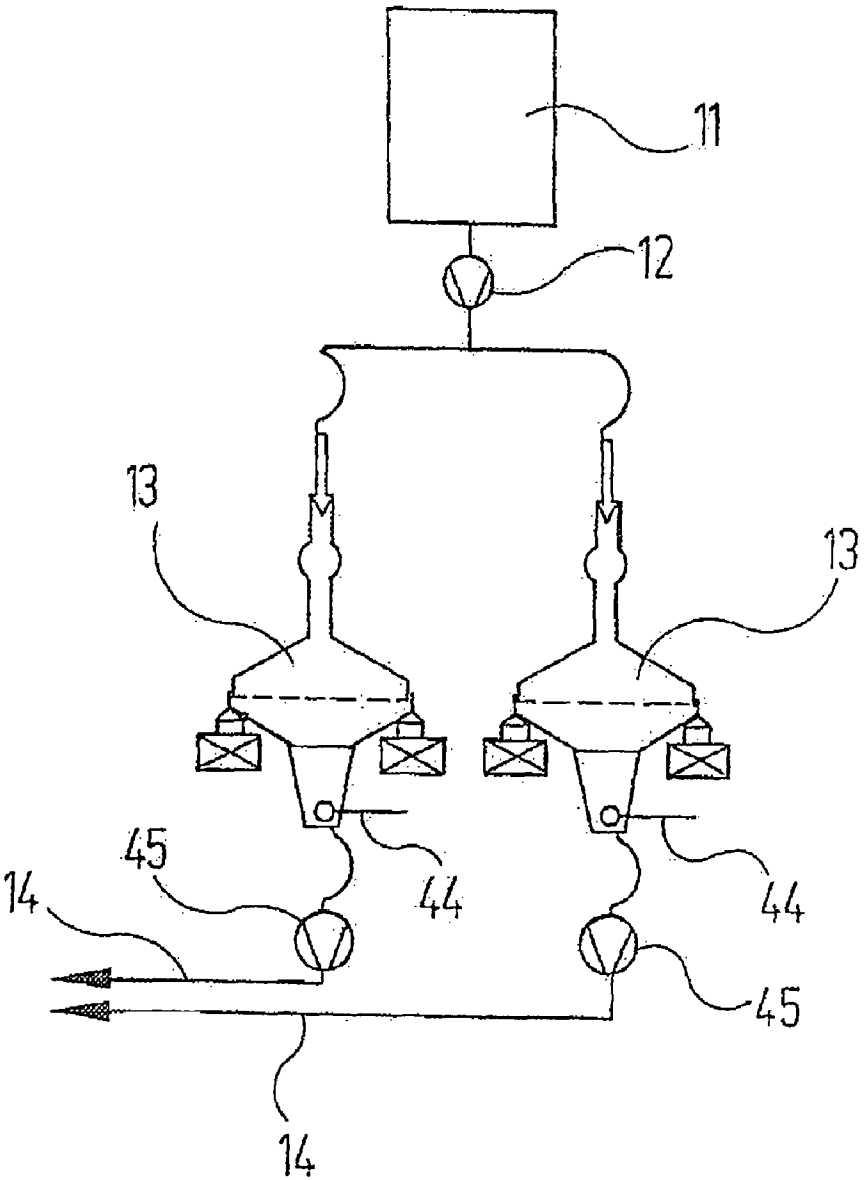
FIG. 2 shows, on a larger scale, a paint-metering device such as is used in the installation in FIG. 1.

As emerges especially clearly from FIG. 2, each storage container 11 is connected, via a pump 12, to two weighing devices 13 which are located in parallel. One of the weighing devices 13 in each pair is assigned, in each case, to the robot 20 represented to the right of the median plane in FIG. 1, while the other of the weighing devices 13 in each pair supplies, in each case, the robot 20 disposed to the left of the median plane in FIG. 1.

The following description is confined to a discussion of those components which are associated with the right-hand half of FIG. 1.

Figure 6:
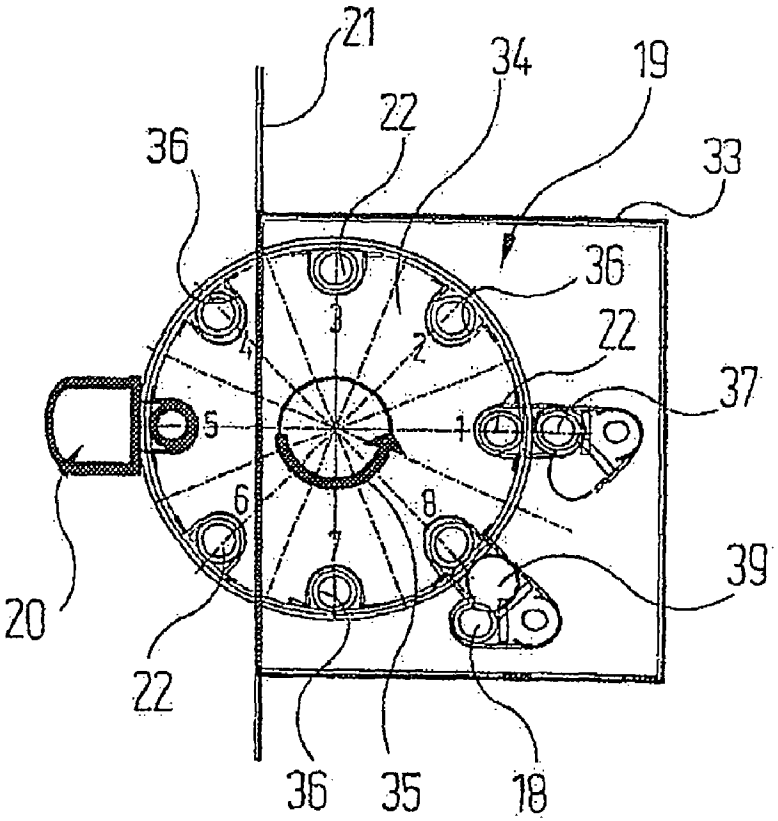
FIG. 6 shows a plan view of the removing carousel in FIG. 5.

The two weighing devices 13 are connected, via lines 14, 15, to a loading carousel 16 which will be described in greater detail later on with the aid of FIGS. 3 and 4. Said loading carousel 16, which may be located in the vicinity of the weighing devices 13, is connected to a removing carousel 19 via two lines or hoses 17, 18 which have a relatively large clear cross-section and may be very long. Said removing carousel 19, which will be described in greater detail later on with the aid of FIGS. 5 and 6, is disposed in the immediate vicinity of a side wall 21 of the painting booth 2 and reaches, in certain regions, into the interior space 3 of said painting booth 2 through an aperture in the said side wall 21, as will likewise become clear later.

Figure 7:
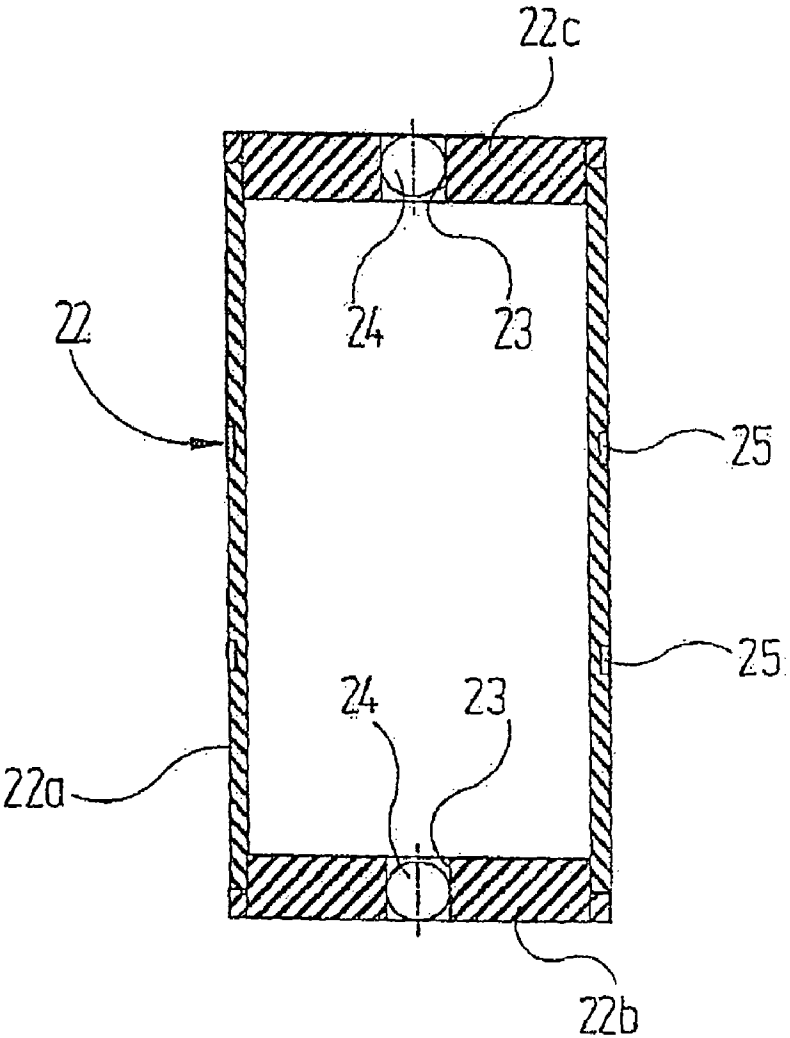
FIG. 7 shows a section through a paint-powder container.

In the loading carousel 16, the paint powder supplied is poured into abrasion-proof paint-powder containers 22 which are preferably made of plastic and whose type of construction can be inferred from the section in FIG. 7. Each paint-powder container 22 has the shape of a hollow circular cylinder with a cylinder wall 22*a*, a bottom 22*b* which is circular in plan view, and a lid 22*c* which is likewise circular in plan view. Located in both the bottom 22*b* and the lid 22*c* is a central through-bore 23 which may be closed in a leakproof manner by an occluding ball 24. Incorporated at an axial interval in the superficies 22*a* of the paint-powder container 22 are two annular recesses 25 which serve for the handling and fixing of the paint-powder containers 22, especially in the two carousels 16 and 19.

Figure 4:
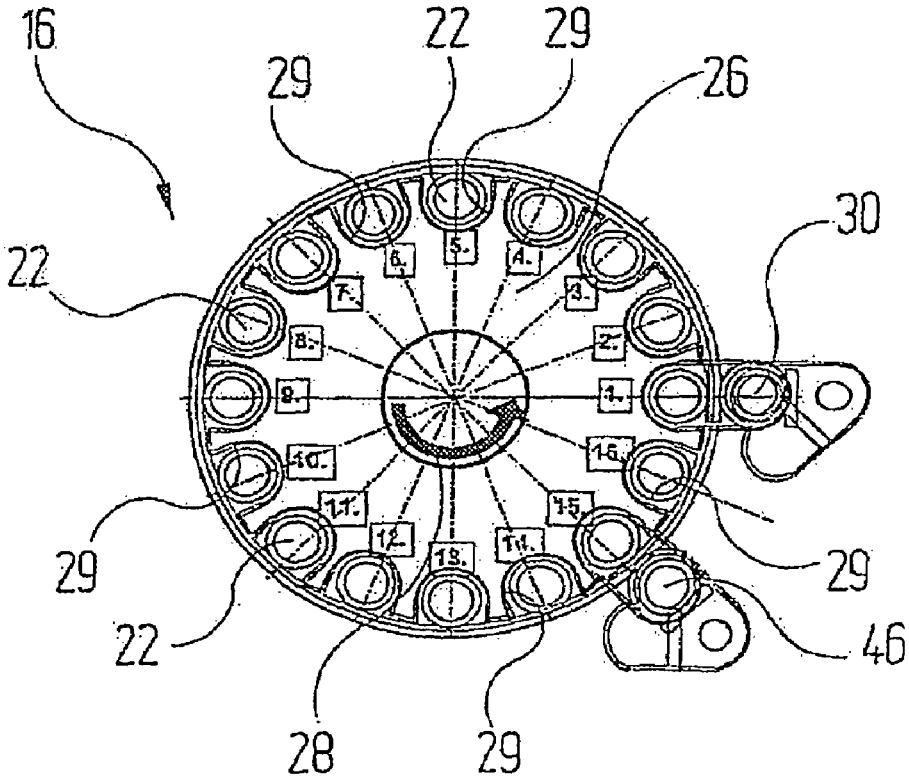
FIG. 4 shows a plan view of the coating carousel from FIG. 3.
Figure 5:
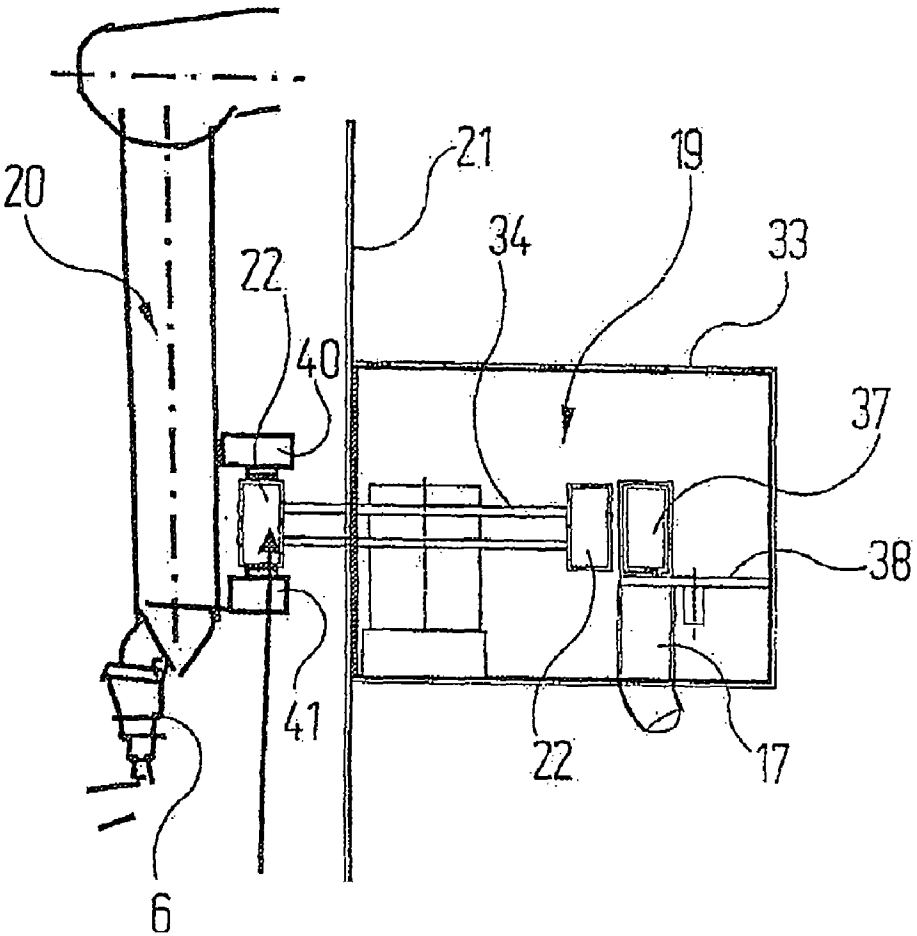
FIG. 5 shows, an axial section through a removing carousel which interacts with a robotic arm and is likewise part of the installation in FIG. 1.

As can be inferred, especially from FIG. 4, the loading carousel 16 has a rotating body 26 which is circular in plan view and can be rotated about the vertical axis of said loading carousel 16 by a motor 27.

The rotating body 26 of the loading carousel 16 contains a plurality of receptacles 29, sixteen in the exemplified embodiment represented, for one paint-powder container 22 in each case. All said receptacles 29 are at the same angular interval from one another. The rotational positions which said receptacles 29 are able to occupy are numbered continuously from 1 to 16 in FIG. 4.

The receptacle 29 located in position 1 is in communication with a sluice ("station") 30 which, for its part, is connected, via an occludable flap 31, to the line 18 which connects the two carousels 16 and 19 to one another. Empty or almost empty paint-powder containers 22 return from the removing carousel 19 to the loading carousel 16 via this line 18.

In position 2 the lid 22*c*, and also, optionally, the bottom 22*b*, is/are removed from the empty paint-powder containers 22. This takes place by means of devices which are not represented or described in greater detail and which may basically be of any desired type of construction. In position 3, the paint-powder containers 22 which have been opened are cleaned, for example blown through. In the following position, 4, the paint-powder containers 22 are provided, once again, with a lid 22*c* and, optionally, a bottom 22*b*, in which case an occluding ball 24 may already be located in the through-aperture 23 in the bottom 22*b*.

In positions 5 to 14, the paint-powder containers 22 located therein are each filled with paint powder, each of the said positions being connected, via a line 14 or 15, to a weighing device 13 and thus ultimately to a storage container 11 for paint powder of the corresponding colour. Basically, therefore, there may be, at most, as many storage containers 11 for different paint powders as there are paint-filling positions in the loading carousel 16.

Figure 3:
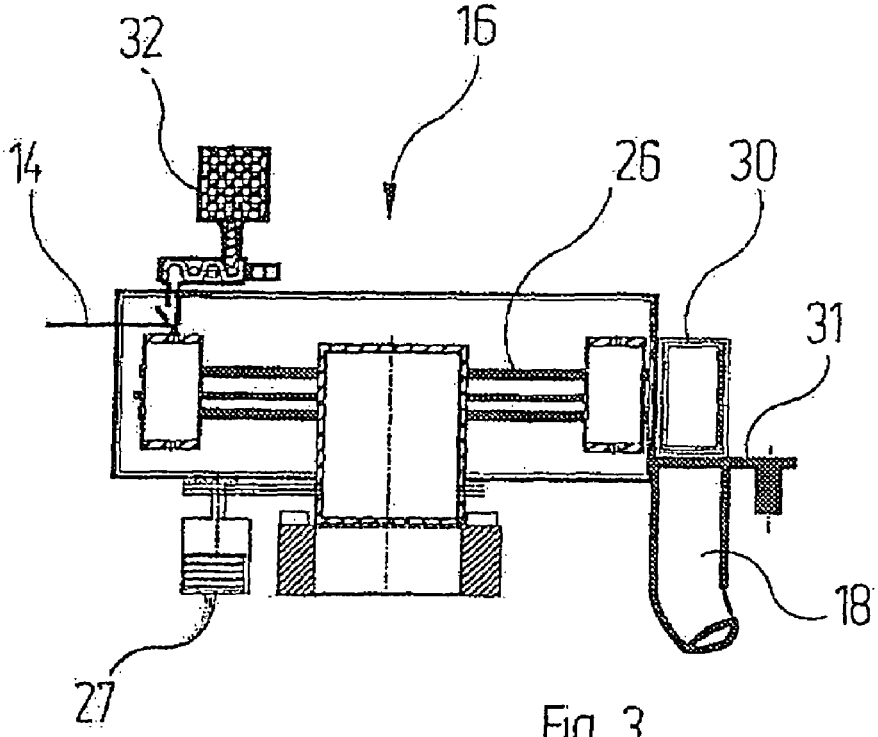
FIG. 3 shows an axial section through a coating carousel which is likewise employed in the installation in FIG. 1.

In FIG. 3, the paint-powder container 22 represented on the left is located in one of the paint-filling positions, namely the position 9. The powder-supplying line 14, which is connected to the corresponding weighing device 13, can be seen in FIG. 3. The paint-powder container 22 located in position 9 is filled up with paint powder from the said paint-supplying line 14 via the bore 23 in the lid 22*c*. Said bore 23 in the lid 22*c* is then occluded with an occluding ball 24 via a diagrammatically represented ball-supplying device 32. In the exemplified embodiment represented, each position in which a paint-powder container 22 cat be filled with paint powder possesses its own ball-supplying device 32. However, it is also possible to provide a separate position of the loading carousel 16, in which all the paint-powder containers 22 are occluded with the aid of the same ball-supplying device 32.

In position 15, the receptacles 29 communicate with another sluice 46, whose exit is controlled, in a manner similar to that of the sluice 30, by a flap—not represented—and leads to the line 17, via which paint-powder containers 22 loaded with paint powder can be conveyed between the loading carousel 16 and the removing carousel 19.

The last position on the loading carousel 16, which position is designated by the number 16, is an emptying position.

The transporting of the empty or filled paint-powder containers 22 through the lines 17 and 18 between the two carousels 16 and 19 takes place after the fashion of a pneumatic tube conveyor with a pushing medium, such as is known per se. As the pushing medium, consideration is given primarily to compressed air.

Details of the removing carousel 19 can be inferred from FIGS. 5 and 6. As already observed above, said removing carousel 19 is disposed in the vicinity of a side wall 21 of the painting booth 2, namely in a subsidiary housing 33 built onto said side wall 21. The type of construction of the removing carousel 19 is basically similar to that of the loading carousel 16. Said removing carousel 19 therefore also possesses a rotating body 34 which is set in rotation in the direction of the arrow 35 in FIG. 6 with the aid of a motor which is not represented. The rotating body 35 of the removing carousel 19 also possesses a plurality of receptacles 36 which are each able to receive a paint-powder container 22. In the exemplified embodiment represented, there are eight such receptacles 36, which are located at the same angular interval from one another. The various positions which can be occupied by the eight receptacles 36 are numbered continuously with the FIGS. 1 to 8 in FIG. 6.

The receptacle 36, which is located in position 1, communicates with a sluice 37 which, for its part, is in communication, via a flap 38, with the line 17 via which paint-powder containers 22 filled by the loading carousel 16 can be supplied. Positions 2 to 4 are pick-up positions and each contain a paint-powder container 22 filled with paint powder.

Position 5 serves as a docking station in which the paint-powder containers 22 located therein are able to dock onto the robotic arm 20. The configuration of this docking station will be described in greater detail later on with the aid of FIG. 8.

Positions 6 and 7 of the removing carousel 19 are occupied by paint-powder containers 22 which have been completely or almost emptied. Finally, in position 83 the paint-powder containers 22 located therein may be transferred out of the corresponding receptacle 36 and into a sluice 39 which establishes, via a flap which is not represented, a connection to the line 18 which leads back to the loading carousel 16.

Figure 8:
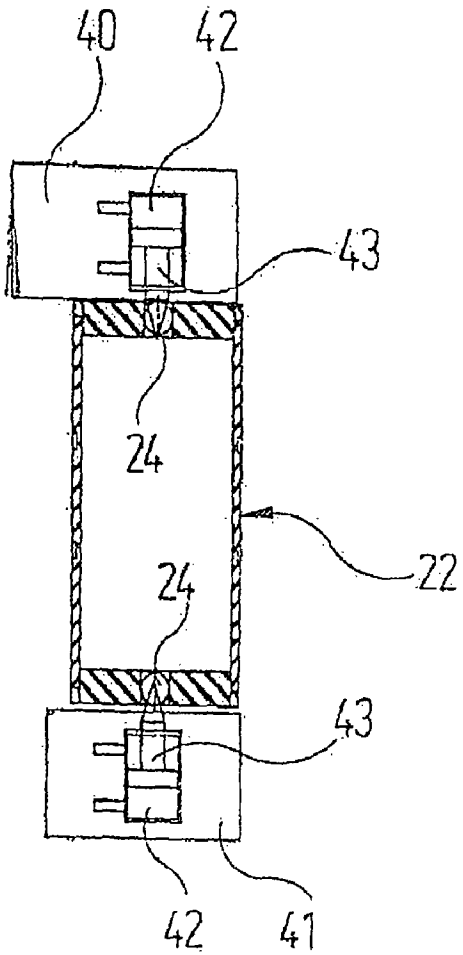
FIG. 8 shows, in section, the paint-powder container in FIG. 7 on a smaller scale, with the docking and opening devices on the robotic arm.

As already mentioned above, the paint-powder containers 22 are delivered to the arm of the robot 20 in the position 5 of the removing carousel 19. For this purpose, said robot 20 possesses, mounted laterally on its arm, two docking and opening devices 40, 41 which serve, on the one hand, for holding a paint-powder container 22 and, on the other hand, for connecting, flow-wise, the interior space of the corresponding paint-powder container 22 to the powder-paint flow paths inside the robot 20 to the applying device 6. As FIG. 8 shows, each docking and opening device 40, 41 possesses, for this purpose, a double-acting pneumatic cylinder 42 whose piston rod 23 is pointed at its outer end. When the paint-powder container 22 is in the docked position, the piston rods 23 are able, on being extended, to press the occluding balls 24 located in the bottom 22*b* and in the lid 22*c* into the interior of said paint-powder container 22 and, in this way, clear the way to lines, of which no further details are represented and via which the Paint powder located in the interior of the paint-powder container 22 can be removed, or air can be supplied to said interior.

For the purpose of explaining the abovedescribed painting installation 1, it will be assumed that a "multicoloured sequence" of vehicle bodies 5 is to be painted. A "multicoloured sequence" is understood to mean a row of vehicle bodies 5 which are of different types which need different quantities of paint, and which are to be painted in different colours.

The control system of the installation knows at any point in time, at what point the individual vehicle bodies 5 are located and the way in which they are to be painted. The control system of the installation receives this knowledge either by automatic programming and the taking-over of the data from a preceding processing station, or by the reading-off of the data from a data-carrier which is conveyed with the vehicle body 5 at a specific distance in front of the painting booth 2, or by manual programming.

It will now be assumed that a specific vehicle body 5 is D located at a distance in front of the painting booth 2 which leaves sufficient time for carrying out the steps described below. The control system of the installation now gives a command to remove paint powder, with the aid of the corresponding pump 12, from that storage container 11 which contains the corresponding colour. Said pump 12 conveys this paint powder into the corresponding weighing devices 13. This supply of paint powder is stopped when there is located, in each of the two weighing devices 13 belonging to the pair, half the total quantity of paint powder which is required for painting the vehicle body 5 in question. The slides 44 at the outlet of the weighing devices 13 are now opened. The paint powder located therein is conveyed by the lines 14, with the aid of pumps 45, to those stations of the two loading carousels 16 which correspond to the particular colour.

For the following description of the operations that continue to run their course in the right-hand half of FIG. 1, it will be assumed that said station is station no. 5 in FIG. 4. Therein, the powder is already being awaited by an empty paint-powder container 22 which has been inserted beforehand in the corresponding receptacle 29 in position 1. The quantity of paint powder which has been measured out by the weighing device 13 is now poured into the paint-powder container 22; after that, the through-bore 24 in the lid 22*c* is occluded with an occluding ball 24 with the aid of the ball occluding device 32. The paint-powder container 22 under consideration is now brought into the position 15 by rotation of the rotating body 26 of the loading carousel 16. There, the paint-powder container 22 is introduced, via the sluice 46, into the line 17 and conveyed, in the latter, to the removing carousel 19 after the fashion of a pneumatic tube conveyor.

The paint-powder container 22 under consideration, which is in position 4 of the removing carousel 19, passes into a receptacle 36 in the rotating body 34 via the sluice 37. Said rotating body 34 is now rotated until the receptacle 36 containing the paint-powder container 22 in question has arrived in position 5. The arm of the robot 20, with the two docking and opening devices 40, 41 which engage over the bottom 22*b* and the lid 22*b* of the paint-powder container 22 which is standing ready, now approaches. The double-acting pneumatic cylinders 42 are actuated; the appertaining piston rods 43 travel out and thrust the occluding balls 24 into the interior of the paint-powder container 22 with their points. At the same time, the flow paths for the powder to the applying device 6 and to the air inlet are cleared.

The control system of the installation has constantly tracked the position of the vehicle body 5 on the conveying system 4 throughout the entire process between the pouring of the paint powder into the paint-powder container 22 in the loading carousel 16 and the making-available of said paint-powder container 22 in docking station 5 of the removing carousel 19, and has ensured that said vehicle body 5 arrives in the painting booth 2 at the same time as the paint-powder container 22 belonging to the said vehicle body 5 is also located in docking station 5 of the removing carousel 19.

The arm of the robot 20 now lifts, with the paint-powder container 22, off docking station 5 of the removing carousel 19 and begins to paint, in known manner, the vehicle body 5 which is standing ready.

After the operations have been completed, the arm of the robot 20 returns into docking station 5 of the removing carousel 19 again and releases the paint-powder container, which has been largely emptied, to the waiting receptacle 36. Already waiting in an adjoining receptacle 36 is a new paint-powder container 22, the contents of which correspond to the requirements of the next vehicle body 5 to be painted, which is standing ready.

As the removing carousel 19 continues to rotate, the emptied paint-powder container 22 travels into position 8, where it passes, via the sluice 39, into the line 18 and, from there, back to the loading carousel 16.

In the above description, only the path of a single paint-powder container 22 has been tracked. It is obvious that, under normal circumstances, the carousels 16 and 19 are loaded with a plurality of paint-powder containers 22, the control system of the installation ensuring that the correct vehicle body 5 and the corresponding paint-powder container 22 meet in the painting booth 2 at any given time.

In the exemplified embodiment of a painting installation 1 described above and represented in FIGS. 1 to 8, the paint-powder containers 22 were so large that they are able to receive the total quantity of paint powder which an applying device 6 needs for painting a vehicle body 5 or that part of a vehicle body 5 which is assigned to the said applying device 6. In a second exemplified embodiment, which is represented in FIGS. 9 to 13, the situation is different: Here, the paint-powder containers 22 possess a comparatively small size, so that they are able to receive, for example, only a few tens of g in each case. They behave in a manner similar to a charge and can be conveyed through a supply line in a manner similar to a pipe-clearing device.

Components of the second exemplified embodiment of a painting installation which correspond to those of the first exemplified embodiment are designated by the same reference numerals, plus 100.

Figure 9:
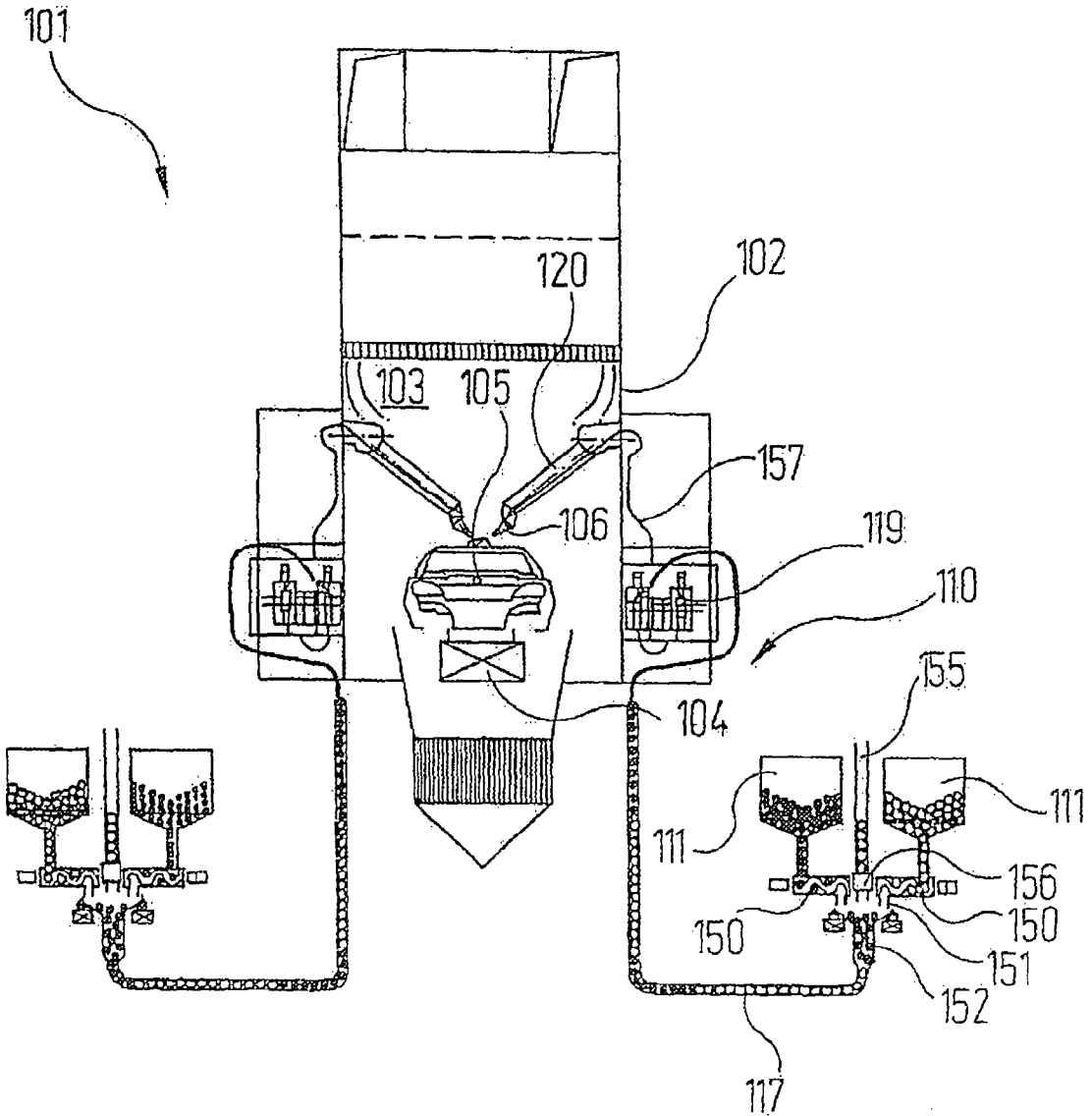
FIG. 9 shows a second exemplified embodiment of an installation for painting vehicle bodies.
Figure 10:
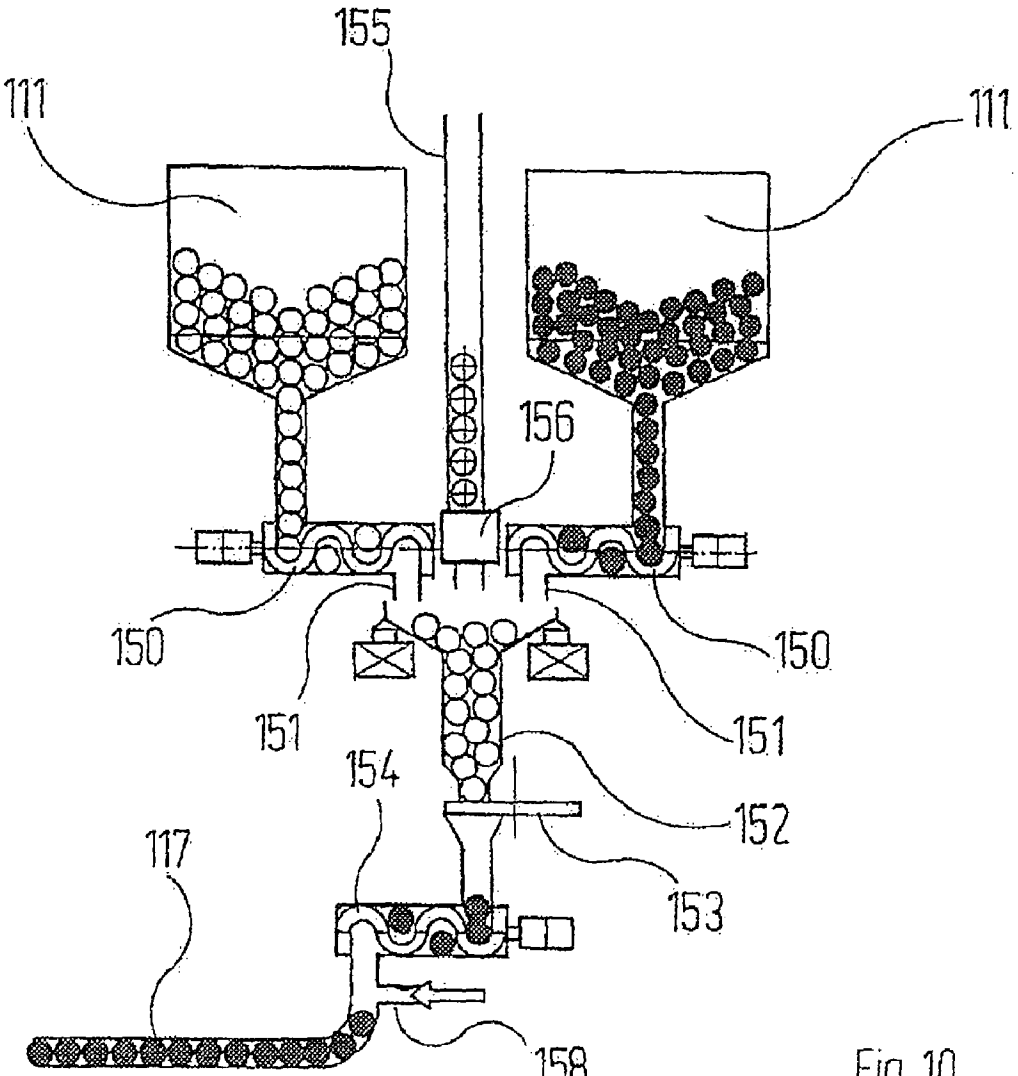
FIG. 10 shows a detail enlargement from FIG. 9.
Figure 12:
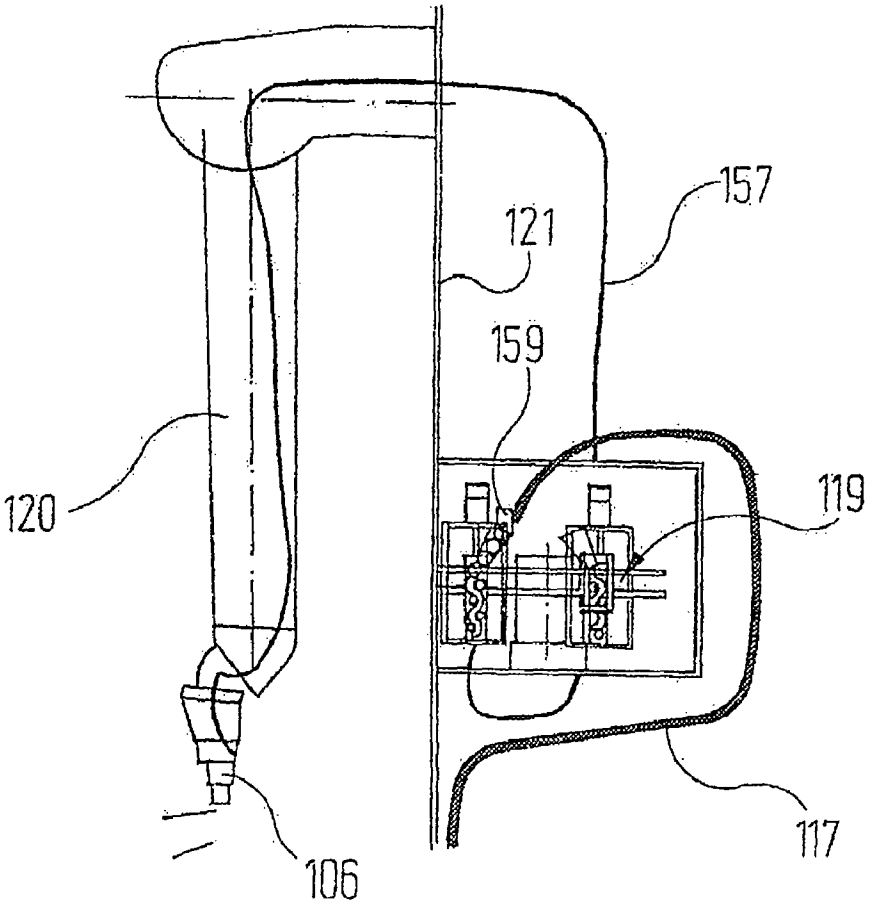
FIG. 12 shows, on a larger scale than in FIG. 9, the robot which is used in the installation in said figure, and also the parts of the paint-supplying device which adjoin said robot; and, FIG. 13 shows, in diagrammatic axial section, a high-rotation atomiser which is connected to a grinding mechanism to form a single unit.

The painting installation 101 represented in FIG. 9 is also set up so as to be essentially symmetrical in relation to its median plane; it is therefore sufficient to describe, below, only the half which is represented to the right of the median plane in FIG. 9.

The applying device 106 guided by the robot 120 sprays paint in powder form onto the vehicle body 105. Each half of the painting installation 101 possesses a paint-supplying device which is provided, as a whole, with the reference numeral 110. Said device comprises a number of storage containers 111—two in the example represented—which are loaded with powder containers. The powder containers of the two storage containers 111 contain paint powders of different colours. Each powder container contains a comparatively small portion of powder, so that a large number of such powder containers is needed in order to paint the vehicle body completely. Their size approximately corresponds to the size of detergent tablets which are currently on the market.

The powder containers themselves consist of clear-lacquer material or bonding agents, that is to say a neutral material which is contained in the paint powder in any case or blends well with said paint powder in the coat of paint when applied.

The powder containers pass out of the interior of the storage container 111, in each case, in a horizontally disposed, motor-driven guide worm 150 and are fed individually by the latter to a lower outlet 151. The outlets 151 are located above the filling hopper of a weighing device 152. Said device is connected, via a movable slide 153, to the inlet of a helical conveyor 154 (cf. FIG. 10).

The outlet of the helical conveyor 154 is, for its part, connected to a supply line 117 which leads to a grinding-mechanism carousel 119. Said carousel is disposed in the immediate vicinity of the robot 120, as close as possible to the applying device 106.

Disposed between the two storage containers 111 is a storage container 155 which contains so-called "separating bodies". These separating bodies may have the same shape as the powder containers, but possess a property which makes it possible to ascertain their position in a line or hose in a contact-less manner from outside. For this purpose, said separating bodies may have special mechanical, magnetic or optical properties in which they differ from the powder containers. For example, they may possess a different density, a different colour or an aperture through which light can pass.

Located at, the lower end of the storage container 155 is a controllable flap 156, via the outlet of which the separating bodies can be released individually into the weighing device 152.

Figure 11:
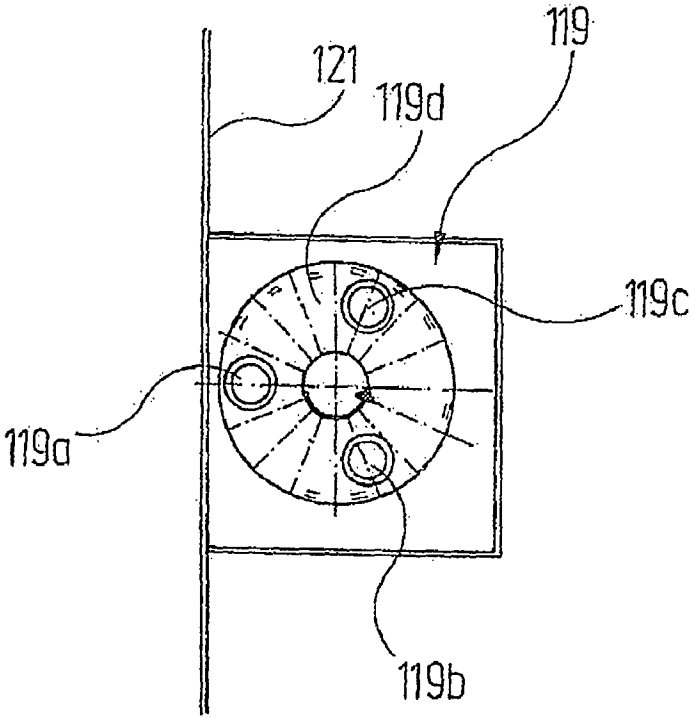
FIG. 11 shows, in plan view, a grinding-mechanism turret which is used in the installation in FIG. 9.

The grinding-mechanism carousel 119 is illustrated in a highly schematized manner in plan view in FIG. 11. It comprises three grinding mechanisms 119*a*, 119*b*, 119*c* which are mounted, at an angular interval of 120*b* in relation to one another, in a cylindrical turret 119*d* which can be rotated about its axis by a motor. The grinding-mechanism carousel 119 is disposed outside the painting booth 102 which is bounded by a side wall 121. The grinding mechanism 119*a* is located at a loading point at which it is connected to the supply line 117. The grinding mechanism 119*b* is located at a cleaning point at which it can be blown out with compressed air or cleaned in some other way. Finally, the grinding mechanism 119*c* occupies a working position in which it is connected to the applying device 106 via a hose 157.

The painting installation 101 described above works as follows:

First of all, the storage containers 11 are filled with powder containers.

If a vehicle body 105 is now brought into the painting booth 102 with the aid of the transport system 104, the quantity of paint required for painting purposes is entered in the control system of the installation, either automatically by reading off the particular type of body, or manually. The transport worm 150 of the storage container 111 containing the correct powder containers now begins to work and to release a sufficient number of powder containers into the weighing device 152 until the weight that corresponds to the required quantity of paint is reached.

The slide 153 of the weighing device 152 is now opened; the powder containers are brought by the helical conveyor 154 into the supply line 117 and conveyed through the latter in any desired mariner to the grinding mechanism 119*a* of the grinding-mechanism carousel 119. In the process, preference is given to the represented conveying system after the fashion of a pipe-clearing device or a pneumatic tube conveyor using a pushing medium which pushes the powder containers in front of it. For this purpose a connection 158 for the pushing medium, which is preferably compressed air, opens into the supply line 117 in the vicinity of the helical conveyor 154 (cf. FIG. 10).

Pipe-clearing devices may also optionally be employed, in a manner such as is known per se from painting technology. The devices which are required for letting the pushing medium out of the supply line 117, and also the pipe-clearing device stations which may optionally be necessary if pipe-clearing devices are employed, are not represented in the drawings; they are known to the person skilled in the art.

The powder containers pass through the supply line 117, which may be of considerable length, without appreciable abrasion, that is to say, without appreciable contamination of the supply line 117.

The grinding-mechanism carousel 119 in FIG. 11 is now rotated anticlockwise by 120°. In the process, the grinding mechanism 119*a*, which is loaded with powder containers, passes into the working position which has previously been occupied by the grinding mechanism 119*c*. Said grinding mechanism 119*c* rotates to the cleaning point which in FIG. 11, is occupied by the grinding mechanism 119*b*. Finally, the latter grinding mechanism, 119*b*, occupies the loading point which the grinding mechanism 119*a* possesses in FIG. 11.

Said grinding mechanism 119*a*, which is now located in the working position and is loaded with powder containers, now begins to crush said powder containers and, in doing so, releases the paint powder located inside. The material of the powder containers themselves likewise become pulverulent and is mixed with the paint powder. In this sense, the grinding mechanism 119*a* serves as an "opening device" for the powder containers.

The powder mixture thus produced, which consists predominantly of paint powder and, to a lesser extent, of the neutral material of the powder containers, is now supplied by the shortest path, via the hose 157, to the applying device 106, which is able to start carrying out the painting operation. When said painting operation is completed, that is to say all the areas of the vehicle body 105 which are to be painted have been coated, the store of powder containers inside the grinding mechanism 119*a* has been used up except for a small surplus.

In the meantime, the grinding mechanism 119*b*, which is now located in the same position as the grinding mechanism 119*a* in FIG. 3, is freshly filled with powder containers, the weight of which once again corresponds to the quantity of paint powder which is needed for the next vehicle body 105 which is to be painted.

In the painting installation 101 represented in FIG. 9, a change of colour is carried out through the fact that, within the weighing device 152, a separating body is placed on top of the last powder container containing the "old" colour, by briefly opening the outlet flap 156 of the storage container 155. The loading of the weighing device 152 then continues with powder containers from the other storage container 111 which contain a different colour. Located in the vicinity of the loading point of the grinding-mechanism carousel 119 is a detector 159 which is capable of recognising the identifying property of the separating bodies, that is to say their differing optical, mechanical or magnetic property, and thereby detecting when the last powder container containing the "old" colour passes through and the rotation of the grinding-mechanism carousel 119 is therefore to be initiated.

Cleaning of the supply line 117 is not normally required when this colour change occurs. The grinding mechanism 119*a*, 119*b*, 119*c* which has previously been active is cleaned, for example by blowing, in that position of the grinding-mechanism carousel 119 which is occupied, in FIG. 11, by the grinding mechanism 119*b*. The very short powder flow-paths in the hose 157 between the grinding mechanism located in the working position at any given time and the applying device 106 are cleaned in a similar manner. These cleaning operations which are minor compared with the prior art can be carried out very quickly and without great outlay.

In this way, multicoloured sequences of vehicle bodies 105 can be painted, one after another, without perceptible interruptions in operation.

The separating bodies may be discharged at the grinding-mechanism carousel 119 and fed back to the storage container 155. However, they may also be crushed and sprayed via the applying device 106 if they consist of a material, for example bonding agent or clear-lacquer material, which is suitable for this purpose.

It is also possible to produce mixed colours by bringing a number of the storage containers 111 located in parallel into action for painting a vehicle body 105. Under those circumstances, depending upon the desired mixed colour, a specific number of powder containers from one storage container 11 and a corresponding number of powder containers containing the other colour from the other storage container 11 are weighed into the weighing device 152. Naturally, the Colouring powder produced by crushing these powder containers in the grinding-mechanism carousel 119 still has to be thoroughly mixed in order to actually produce a homogeneous mixture of powders prior to application.

The weighing device 152 employed for weighing out a specific quantity of paint may also be replaced by a counting device which counts off the powder containers passing through, which each contain a specific quantity of paint powder.

In the exemplified embodiment last described above, use is made of powder containers which each possess, when filled, a weight of some ten grams. Basically, however, it is also possible to employ smaller "units".

The powder containers may basically have any desired shape. Consideration may be given, especially, to a spherical, cylindrical or tablet shape; the choice of shape is made in the individual cased taking into account the paint material, the method by which the powder containers are conveyed and also the method by which said containers are opened again.

As the method of conveying the powder containers mention was made above of a pushing medium. However, consideration may be given to any desired methods of conveyance, whether the latter are now mechanical, pneumatic or hydraulic, by means of pressure or negative pressure.

The powder containers may be opened in some way other than by the abovementioned grinding-mechanisms 119*a*, 119*b*, 119*c*. Thus, it is basically possible to cut open the powder containers and remove the paint powder contained therein in this way. The cut-up containers are then disposed of.

Figure 13:
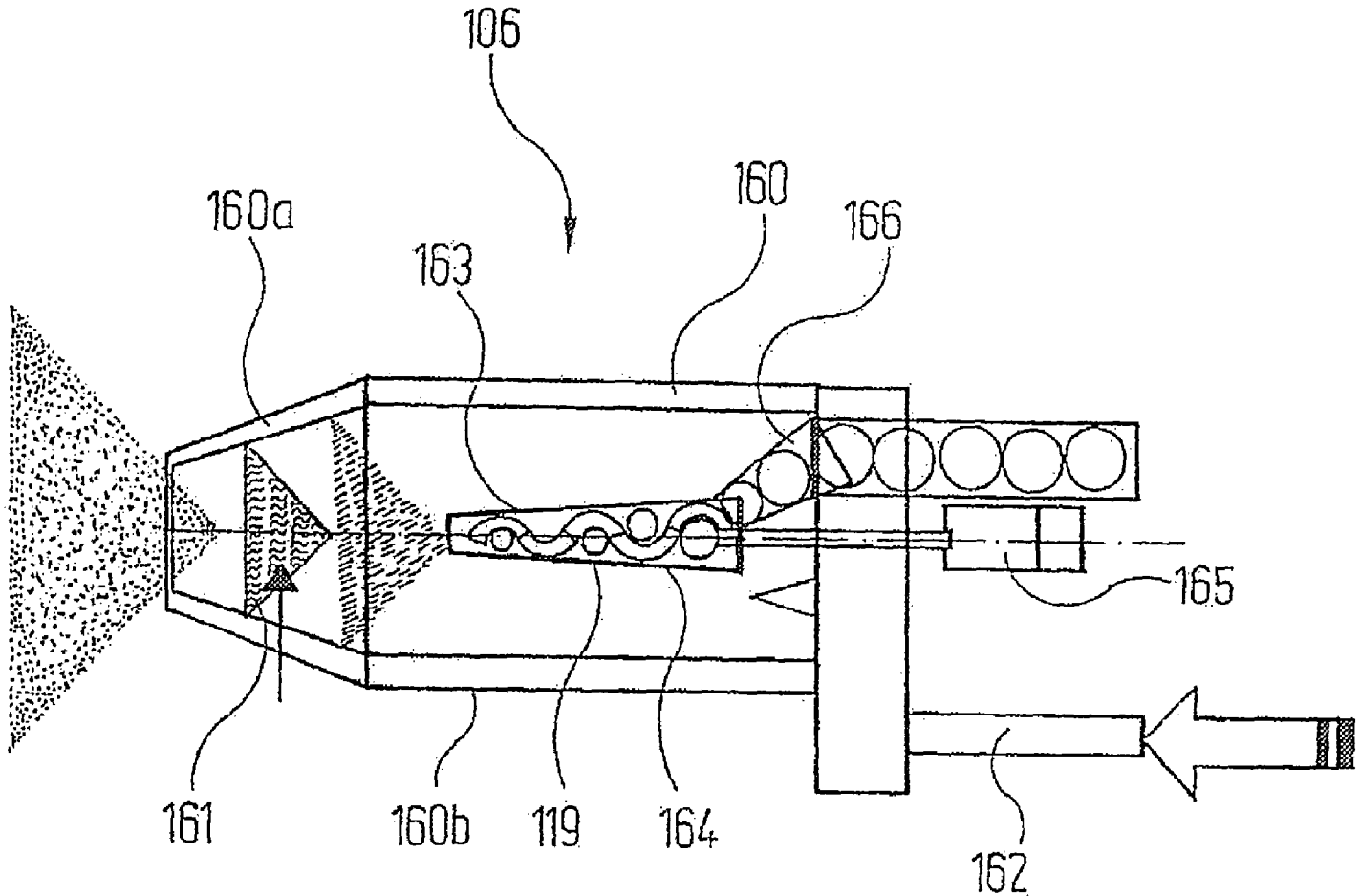

FIG. 13 shows, in a highly diagrammatic way, an applying device 106 into which a grinding mechanism 119 is integrated. Located in known manner in the front end region 160*a*, which tapers in a conical manner, of the common housing 160 is an air turbine 161, to which compressed air can be supplied via a rearward compressed-air connection 162 and is set in rapid rotation in this way. Located in the cylindrical region 160*b* of the housing 160 is the grinding mechanism 119 which has a grinding-mechanism housing 163 which tapers conically in the forward direction. A conveyer worm 164, the spirals of which become lower and narrower towards the front end, is rotatably mounted in the grinding-mechanism housing 163. Said conveyer worm 164 can be rotated by a motor 165. The filled powder containers arriving by the hose 157 (cf. FIGS. 9 and 12) pass in via an inlet 166 at the rear end, which is larger in diameter, of the grinding-mechanism housing 163.

The applying device 106 works as follows:

The air turbine 161, and the atomising rotary table connected thereto, are set in rotation by supplying compressed air via the connection 162. The powder containers are supplied, via the entry 166, to the further region of the grinding-mechanism housing 163, where they are picked up by the conveyer worm 164 and transported in the direction of the narrower, front end of said grinding-mechanism housing 163. Because of the geometry of the conveyer worm 164 and of the grinding-mechanism housing 163, the powder containers are themselves pulverised in the process and release the paint powder that they contain. The powder mixture produced is released at the front, open end of the grinding-mechanism housing 163, in the manner which is represented diagrammatically, and then passes into the region of the rotary table driven by the air turbine 161, is atomised in this way, in the form which is likewise represented diagrammatically, and directed towards the article to be painted.

In an exemplified embodiment which is not represented in the drawings, both the grinding mechanism 119 and the turbine 161 are driven by the same motor.

It is again emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the spirit of the invention and the scope of protection is only limited by the accompanying claims.

The invention claimed is:

1. A method of coating articles, comprising the steps of:

conveying a coating material to an applying device; and, applying the coating material in a powder form;

wherein portions of the coating material are conveyed, at least over part of a route of the coating material to the applying device, in a plurality of containers that are formed of a material which is abrasion proof in relation to the coating material, from which the pulverulent coating material is released only adjacent to said applying device.

2. The method of claim 1, wherein the quantity of coating material needed by an applying device for a complete coating operation for a specific article is weighed out and conveyed, as a whole, in one of the plurality of powder containers.

3. The method of claim 2, wherein one of the plurality of powder containers includes a holding capacity of approximately 2000 g of coating material.

4. The method of claim 2, wherein at least one of the plurality of powder containers is fed back to a storage container after being emptied of the coating material.

5. The method of claim 4, wherein at least one of the plurality of powder containers is cleaned after being emptied of the coating material.

6. The method of claim 1, wherein portions of coating material which are small, compared to the total quantity of coating material which is needed for a coating operation, are conveyed in a plurality of correspondingly small powder containers.

7. The method of claim 6, wherein the total quantity of coating material supplied to the applying device is determined by counting the plurality of powder containers conveyed.

8. The method of claim 6, wherein at least one of the plurality of powder containers includes a holding capacity for coating material approximately less than 50 g.

9. The method of claim 6, wherein at least one of the plurality of powder containers is comprised of plastic or metal.

10. The method of claim 6, wherein at least one of the plurality of powder containers is comprised of a clear-lacquer material.

11. The method of claim 6, wherein at least one of the plurality of powder containers is discarded after being emptied.

12. The method of claim 6, wherein at least one plurality of the powder containers is crushed in order to empty it, and is supplied to the applying device together with the coating material.

13. The method of claim 1, wherein the plurality of powder containers are conveyed through a supply line by a pushing medium after fashioning of a pneumatic tube conveyor or a pipe-clearing device.

14. The method of claim 13, wherein the pushing medium is compressed air.

15. A system for coating articles, the system comprising:

an applying device which releases the coating material in powder form;

a supplying device which supplies the coating material to the applying device;

the supplying device being configured in such a way that it is able to transport the pulverulent coating material in a plurality of powder containers that are formed of a material which is abrasion proof in relation to the coating material, wherein at that end of the supplying device, which faces towards the applying device, an opening device is provided which is able to open each of the plurality of the powder containers and remove the pulverulent coating material from within and pass it on to the applying device.

16. The system of claim 15, further comprising a loading device at which the pulverulent coating material is poured into at least one of the plurality of powder containers.

17. The system of claim 16, wherein the loading device is constructed in such a way that the plurality of powder containers can be moved, by means of the loading device, from an inlet station for empty powder containers to a filling station, and from there to an outlet station for powder containers which have been filled.

18. The system of claim 17, wherein the loading device includes a number of filling stations for different types of coating materials.

19. The system of claim 17, wherein the inlet station and the outlet station of the loading device are configured as sluices at which delivery of powder containers from and to, respectively, a line operating after fashioning of a pneumatic tube conveyor can take place.

20. The system of claim 17, wherein the loading device includes an opening position at which empty powder containers can be opened.

21. The system of claim 17, wherein the loading device includes a cleaning position at which powder containers which have been opened can be cleaned.

22. The system of claim 17, wherein the loading device has a closing position at which powder containers that have been filled can be occluded.

23. The system of claim 22, further comprising occluding balls for occluding powder containers.

24. The system of claim 17, wherein the loading device is constructed as a loading carousel.

25. The system of claim 15, further comprising a removing device which is constructed in such a way that the plurality of powder containers can be moved, by means of the remaining device, from an inlet station for powder containers which have been filled to an opening station at which an opening device can be disposed or is disposed, to an outlet station for empty powder containers.

26. The system of claim 25, wherein the removing device has at least one stand-by station at which a filled powder container can be temporarily parked.

27. The system of claim 25, wherein the inlet station and the outlet station of the removing device are configured as sluices at which delivery of plurality of powder containers from and to, respectively, a line of the pneumatic tube conveyor type can take place.

28. The system of claim 25, wherein the removing device is constructed as a removing carousel.

29. The system of claim 15, further comprising weighing device by means of which a quantity of coating material needed by an applying device for a complete coating operation for a specific article can be weighed out.

30. The system of claim 15, wherein one of the plurality of powder containers contains the total quantity of coating material which is needed by an applying device for a complete coating operation for a specific article.

31. The system of claim 30, wherein the one of the plurality of powder containers has a holding capacity of about 2000 g.

32. The system of claim 15, wherein each of the plurality of powder containers is so small that it holds only a fraction of the total quantity of coating material required by an applying device for a complete coating operation for a specific article.

33. The system of claim 32, wherein each of the plurality of powder containers includes a capacity of less than 50 g.

34. The system of claim 32, further comprising a counting device by means of which the plurality of powder containers conveyed in the direction of the applying device can be counted.

35. The system of claim 15, wherein at least one of the plurality of the powder containers is comprised of plastic or metal.

36. The system of claim 15, wherein at least one of the plurality of powder containers is comprised of clear-lacquer material.

37. The system of claim 15, further comprising a separating-body-introducing device by means of which at least one separating body, which has at least one property which is remotely detectable, can be inserted between the plurality of powder containers having different contents.

38. The system of claim 15, wherein the opening device and the applying device are combined to form one structural unit.

39. The system of claim 15, wherein the opening device includes a grinding mechanism.

40. The system of claim 39, wherein the applying device is a rotation atomiser and the grinding mechanism and rotation atomiser can be driven by the same motor.

* * * * *